United States Patent [19]

Fujita et al.

[11] 3,958,493

[45] May 25, 1976

[54] MULTIPLE-STAGE ACTUATING DEVICE

[75] Inventors: Tomomitsu Fujita, Yokohama; Yoshiaki Imai, Tokyo; Masaaki Ohno, Tokyo; Toshio Ohyagi, Tokyo, all of Japan

[73] Assignee: Tokico Ltd., Kawasaki, Japan

[22] Filed: Aug. 20, 1974

[21] Appl. No.: 499,013

[30] Foreign Application Priority Data

| | | |
|---|---|---|
| Aug. 20, 1973 | Japan | 48-93112 |
| June 18, 1974 | Japan | 49-68672 |
| June 18, 1974 | Japan | 49-68674 |
| July 5, 1974 | Japan | 49-76408 |
| July 5, 1974 | Japan | 49-76409 |

[52] U.S. Cl. ..... 91/411 R; 92/13.1; 92/13.6; 92/13.8; 92/62; 92/152; 251/31

[51] Int. Cl.[2] ..... F15B 11/14

[58] Field of Search ..... 92/62, 13.1, 13.6, 13.8, 92/152; 91/411 R, 443; 251/31

[56] References Cited

UNITED STATES PATENTS

| | | | |
|---|---|---|---|
| 1,145,318 | 7/1915 | Kirchhofer | 251/31 |
| 1,910,663 | 5/1933 | Abercrombie et al. | 251/31 |
| 2,652,033 | 9/1953 | Shafer | 251/31 |
| 2,896,413 | 7/1959 | Hussey | 92/62 |
| 2,940,263 | 6/1960 | Cudnohufsky | 91/447 |
| 2,974,637 | 3/1961 | Holmes et al. | 91/443 |
| 3,149,537 | 9/1964 | Fink | 92/62 |
| 3,452,961 | 7/1969 | Forsman | 251/31 |

*Primary Examiner*—Martin P. Schwadron
*Assistant Examiner*—George L. Walton
*Attorney, Agent, or Firm*—Haseltine, Lake & Waters

[57] ABSTRACT

An actuating device comprises a cylinder of hollow cylindrical form a plurality of pistons respectively of different operational strokes slidably fitted within the cylinder and undergoing sliding displacements in a mutually unitary manner in regions where their strokes overlap and in a separate manner in regions where their strokes differ under driving force due to a working fluid supplied into and discharged from the cylinder interior through ports provided in the cylinder, a working fluid system for supplying the working fluid and having at least one changeover valve for controlling the working fluid supply into and discharge from the cylinder, the piston of longest stroke among the pistons being a driving piston, and a driven shaft coupled to the driving piston thereby to be driven by the sliding displacement thereof. The driving piston undergoes sliding displacement in a noncontinuous manner in multiple stages, whereby the driven shaft is driven in multiple stages.

4 Claims, 10 Drawing Figures

MULTIPLE-STAGE ACTUATING DEVICE

BACKGROUND OF THE INVENTION

The present invention relates generally to actuating devices and more particularly to an actuating device capable of actuating a driven member in a multiple-stage manner by means of a plurality of pistons slidingly operating in a single cylinder.

In the equipment used in the petroleum industry and the chemical industry, in general, there are frequent instances where, for the purpose of shipping by marine transportation or by land transportation, liquids are transferred from large stationary storage tanks constituting sources of the liquids to liquid reservoir tanks for transportation. In such a case, a fixed quantity liquid supplying device which automatically stops its liquid supplying operation when the quantity of liquid supplied reaches a predetermined fixed value is used.

In some instances, the liquid to be supplied to the liquid reservoir tank is a liquid which easily foams or a liquid which generates static electricity at the time of liquid supply because of liquid friction and residual gases within the reservoir tank prior to charging of the liquid thereinto. When such a liquid is to be supplied, the following multiple-stage valve operation is desirable in order to prevent undesirable occurrences such as foaming and generation of static electricity. The liquid is initially supplied through a liquid supply pipeline provided with a shut-off valve with this valve in a suitably throttled state until the supplied liquid level within the reservoir tank rises to a specific height, and, thereafter, the valve is fully opened to increase the flowrate to its maximum value. Furthermore, upon completion of the supplying of the liquid, it is desirable that the valve closing operation also be carried out stepwise by first throttling the liquid flowrate to a certain extent immediately prior to full closing of the shut-off valve in order to prevent water hammering and then to close fully the valve.

Among the devices known heretofore for causing a shut-off valve to undergo multiple stage valve operation, there has been one device in which there is provided, for example, a positioner by which the degree of opening of the shut-off valve is controlled. However, a system for supplying working fluid signals for a multiple-stage shut-off valve to this positioner becomes very complicated, and the entire device becomes expensive.

Furthermore, for the case of a device in which a ball valve is used as a shut-off valve, there has been a device wherein the operations of a plurality of cylinders respectively of different diameters are respectively controlled independently, and the ball valve is operated in multiple stages in opening and closing by the operations of these cylinders. By this arrangement, however, a plurality of cylinders are used, and the ball valve is operated in opening and closing action by the actuating power derived respectively from these cylinders. For this reason, this device has been accompanied by problems such as complicated structure and operational trouble.

SUMMARY OF THE INVENTION

It is a general object of the present invention to provide a novel and useful actuating device in which the above described difficulties of the prior art have been overcome.

A specific object of the invention is to provide an actuating device in which a plurality of pistons are slidably fitted in a single cylinder body and are caused to undergo respective operations in multiple stages, and multiple-stage actuating power can be derived. By this provision in the actuating device of the invention, a fixed partition wall is not provided within the cylinder body, and for this reason, the construction is simple and inexpensive, and, moreover, the fabrication, maintenance, checking of the device, and the like work are facilitated.

Another object of the invention is to provide a multiple-stage actuating device which is highly suitable for use particularly in operating in multiple-stage opening and closing action of a shut-off valve of a fixed quantity liquid supplying apparatus.

Still another object of the invention is to provide an actuating device whereby a first-stage closure of a shut-off valve in a liquid supplying pipeline is carried out relatively gradually so as not to cause water hammering in the pipeline which would otherwise accompany the valve closure.

Other objects and further features of the invention will be apparent from the following detailed description with respect to preferred embodiments of the invention when read in conjunction with the accompanying drawings.

DETAILED DESCRIPTION

Figure 1:
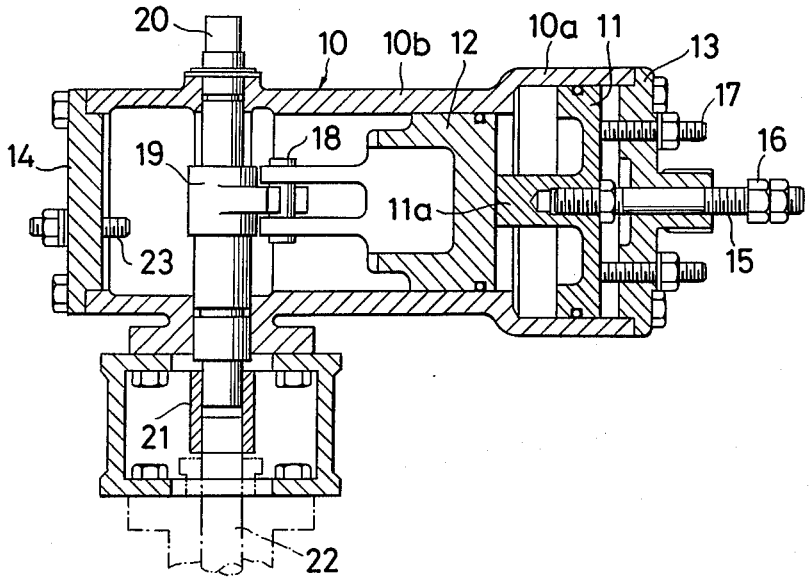
FIG. 1 is a plan view, in longitudinal section through a horizontal plane, showing one embodiment of an actuating device according to the invention.
Figure 2:
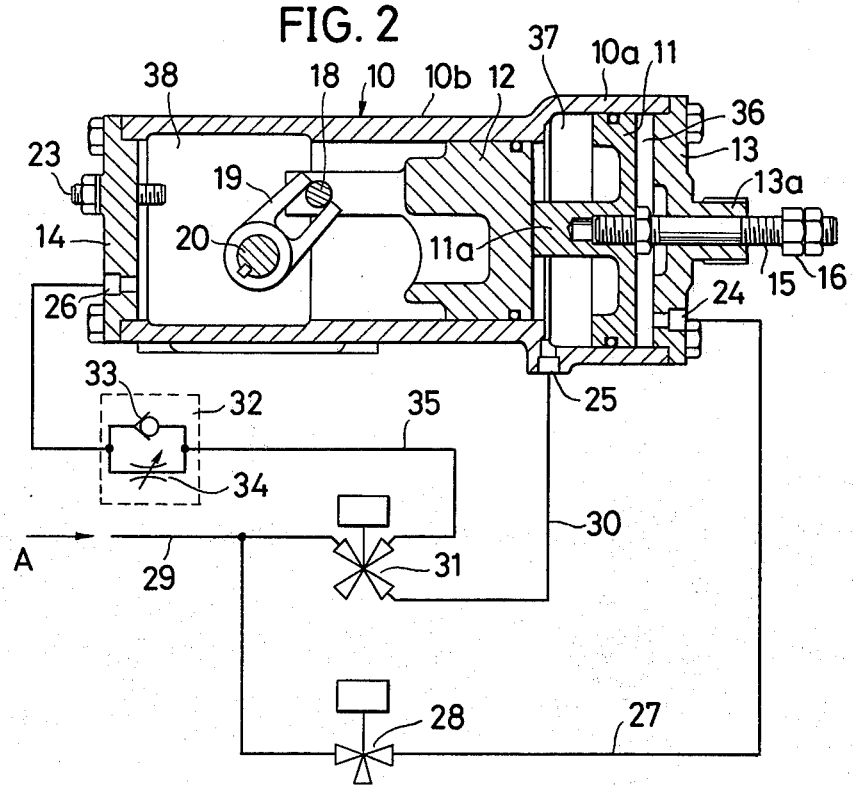
FIG. 2 is a side view, in longitudinal section through a vertical plane, showing the same actuating device together with a schematic diagram of a pneumatic system for supplying compressed air for operating the actuating device.

Referring first to FIGS. 1 and 2, there is shown therein a first embodiment of an actuating device according to the invention. In this device, there is provided a cylinder body 10 having a large-diameter cylinder part 10*a* and a small-diameter cylinder part 10*b* coaxially and contiguously joined to the large-diameter cylinder part 10*a*. Within these large-diameter and small-diameter cylinder parts 10*a* and 10*b*, there are respectively fitted a large-diameter piston 11 and a small-diameter piston 12 adapted to slide in their respective cylinder parts in the axial directions thereof. The outer ends of the cylinder parts 10*a* and 10*b* are respectively closed in a gas and liquid tight manner by covers 13 and 14.

A stop rod 15 for stopping is fixed at an inner end thereof coaxially to the central part of the large-diameter piston 11 and extends outward through the cover 13, the rod 15 being slidably held by the cover 13. A stop nut 16 is secured by screw engagement with the outer end of the stop rod 15. In addition, the cover 13 is provided with stop rods 17 extending inward into the cylinder 10*a*. The limit of inward stroke (i.e., leftward stroke as viewed in FIG. 1) of the large-diameter piston 11 is set by the stop nut 16, while the limit of outward (rightward) stroke is determined by the stop rod 17. The limit of inward stroke of the large-diameter piston 11 is adjusted by adjusting the secured position of the stop unit 16. The piston 11 is further provided at its central part on its inner side with a projection 11*a* formed integrally therewith and being capable of abuting against the head of the small-diameter piston 12.

The piston 12 is coupled to a rotatable shaft 20 through a pin 18 and a yoke link 19, whereby leftward and rightward (as viewed in FIG. 1) sliding movements of the piston 12 are transmitted to cause rotation of the shaft 20. This shaft 20 is coupled by a connector 21 to, for example, the valve shaft 22 of a ball valve (not shown), for example. The cover 14 is provided with a stop 23 for setting the limiting position of the leftward sliding movement of the piston 12.

As shown in FIG. 2, the cover 13 is provided with a port 24 communicating with a space or chamber 36 between the cover 13 and the large-diameter piston 11. The cylinder body 10 is provided with a port 25 communicating with a space or chamber 37 between the two pistons 11 and 12. The cover 14 is provided with a port 26 communicating with a space or chamber 38 between the cover 14 and the piston 12.

As also indicated in FIG. 2, the port 24 is connected by way of pipe line 27, a 3-way electromagnetic (solenoid) valve 28 to a pipe line 29 connected to a compressed air source (not shown). The port 25 is connected by way of a pipe line 30 and a 4-way electromagnetic valve 31 to the pipe line 29. The port 26 is connected by way of a flowrate control device 32, a pipe line 33, and the 4-way electromagnetic valve 31 to the pipe line 29. The flowrate control device 32 comprises a check valve 33 and a variable throttle 34 and operates, on one hand, to permit rapid flow through the check valve 33 of air flowing from the port 26 to the 4-way valve 31 and, on the other hand, to cause air flowing from the 4-way valve 31 to the port 26 to flow gradually as a result of the throttle 34.

The actuating device of the above described construction and connection according to the invention operates as follows. First, when the 3-way electromagnetic valve 28 is opened, compressed air supplied in the direction of arrow A from the above mentioned compressed air source to the pipe line 29 flows through the 3-way valve 28 and the pipe line 27, through the port 24, and into the space 36 within the cylinder body 10. At this time, the above mentioned space 37 is opened to the atmosphere by way of the 4-way valve 31, while the above mentioned space 38 is being supplied with compressed air from the pipe line 29. Consequently, although the spaces 36 and 38 are filled with compressed air at the same pressure, the piston 11 slides inward, i.e., toward the left as viewed in FIGS. 1 and 2, to a position where the stop nut 16 abuts against the outer end face of the outwardly projecting part 13*a* of the cover 13 since the piston 11 has a greater diameter than the piston 12 and therefore has a greater head area on which the above mentioned compressed air pressure acts.

Figure 3:
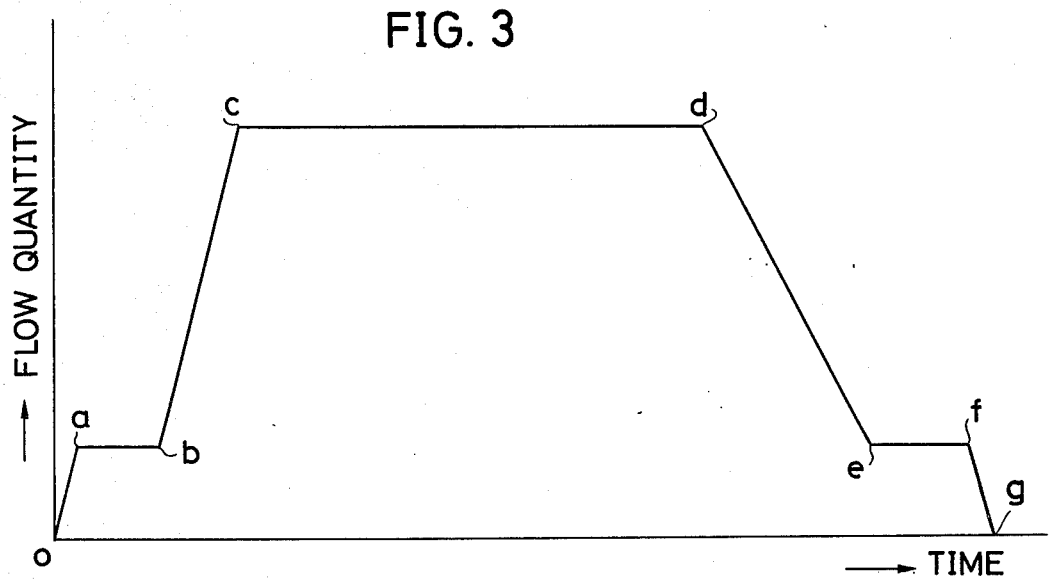
FIG. 3 is a graph indicating the variation with time of the flowrate of a liquid at the time of fixed quantity liquid supply with two-stage valve opening and closing action.

As a result of this leftward movement of the piston 11, its projection 11*a* pushes against the piston 12, which thereby slides leftward unitarily with the piston 11. Consequently, the shaft 20 and the valve shaft 22 rotate, and the ball valve (not shown) carries out its first-stage valve opening action. Together with this first-stage valve opening action, the flowrate of a liquid flowing through a liquid supply pipeline is caused by the ball valve to increase as indicated by the line between points *o* and *a* in FIG. 3. After this first-stage valve opening action, supply of the liquid is carried out with the flowrate indicated by the line between points *a* and *b*.

Then, when the 4-way electromagnetic valve 31 is changed over with the 3-way electromagnetic valve 28 maintained in its opened state, the pipe line 30 is communicated with the pipe line 29, while the pipe line 35 is communicated with atmosphere. Consequently, the compressed air in the pipe line 29 flows through the 4-way valve 31 and the 30 enters the chamber 37 through the port 25. On the other hand, the compressed air within the chamber 38 is discharged through the port 26, the flowrate control device 32, and the pipe line 35 to the atmosphere.

For this reason, the piston 11 undergoes no displacement because the pressure imparted by the compressed air in the chamber 37 and the back pressure of the chamber 37 are equal, but, since the chamber 38 is opened to the atmosphere, the piston 12 is acted on by the pressure of the compressed air in the chamber 37 and undergoes sliding displacement toward the left as viewed in FIGS. 1 and 2 up to a position where it is stopped by the stop 23. At this time, the discharge of the compressed air within the chamber 38 to the atomosphere takes place rapidly through the check valve 33.

As a result of this leftward sliding movement of the piston 12, the shaft 20 and the valve shaft 22 are rotated counterclockwise, and the ball valve carries out its second stage opening (fully opening) action. Together with this second-stage valve opening action, the flowrate of the liquid flowing through the liquid supply pipeline and the ball valve increases as indicated by line $\overline{b\ c}$ in FIG. 3, and then, after this second-stage valve opening action, the liquid is supplied at a flowrate as indicated by the line between *c* and *d*.

Next, with the 3-way electromagnetic valve 28 held in its opened state, the 4-way valve 31 is changed over, whereupon the pipe line 30 is communicated with the atmosphere, and the pipe line 35 is communicated with the pipe line 29. Consequently, the compressed air within the chamber 37 is discharged into the atmosphere, while compressed air from the pipe line 29 is supplied by way of the 4-way valve 31, the pipe line 35, the flowrate control device 32, and the port 26 into the chamber 38. At this time, this compressed air supply to the chamber is carried out gradually through the variable throttle 34 of the flowrate control device 32.

The piston 12 then slides gradually toward the right until it reaches a piston where it abuts against and is stopped by the projection 11*a* of the piston 11, which is already in its position at the limit of its leftward stroke as described above. As a consequence, the shaft 20 and the valve shaft 22 rotate clockwise, and the ball valve carries out its first-stage closing action. Since the piston 12 slides gradually during this operation, the ball valve closes gradually, and the flowrate of the liquid flowing through the liquid supply pipeline gradually decreases as indicated between points *d* and *e* in FIG. 3. Accordingly, water hammering in the liquid supply pipeline due to the closure of the ball valve is positively prevented. After this first-stage valve closure, the liquid flows with a flowrate as indicated between points *e* and *f* in FIG. 3.

Next, with the 4-way valve 31 held in the above described changed over state, the 3-way valve 28 is changed over to communicate the pipe line 27 with the atmosphere. As a consequence, the compressed air within the chamber 36 is opened to the atmosphere through the pipe line 27 and the 3-way valve 28, whereby the pressure within the chamber 36 drops. Consequently, the pistons 12 and 11, in their mutually contacting state, are pushed by the pressure within the chamber 38 toward the right to positions at which the piston 11 is stopped by the stop rod 17.

As a result of this rightward movement of the piston 12, the shaft 20 and the valve shaft 22 rotate further in the clockwise direction, and the ball valve carries out its second-stage closing (fully closing) action. As a consequency of the second-stage valve closure, the flowrate of the liquid flowing through the liquid supply pipeline decreases as indicated between points *f* and *g* in FIG. 3, and at the point *g*, the liquid supply is completed. This second-stage valve closure is rapidly effected, whereby the correct constant fuel supply is performed.

By thus actuating a shut-off valve provided in a liquid supply pipeline with the actuating device of the invention, the opening and closing of this valve can be easily accomplished in several stages. The actuating device of the invention is particularly effective and useful when it is applied to liquid supplying devices for supplying fixed or constant quantities of liquids.

While, in the above described embodiment, two-stage opening of a ball valve is accomplished, in the case where a one-stage action for full valve opening in a single operation is to be carried out, the 3-way valve 28 is placed in the closed state, and, without supplying compressed air to the chamber 36, compressed air supplied from the beginning to the chamber 37 through the 4-way valve 31 thereby to cause the piston 12 to undergo a full stroke.

A second embodiment of the actuating device according to the present invention will now be described with reference to FIG. 4, in which parts which are the same as corresponding parts in FIG. 2 are designated by like reference numerals. Detailed description of such parts will not be repeated.

In this second embodiment, an adjusting screw rod 40 is screwed thorugh a tapped hole formed through the center of the piston 11 in the axial direction thereof. The piston 11 in this embodiment is not provided with a projection 11*a* as in the preceding embodiment, but, instead, the screw rod 40 projects leftward (as viewed in FIG. 4) from the piston 11 and is abuttable against the piston 12. The right end of the screw rod 40 protrudes slightly from the outer or right side of the piston 11 and is fixed to the piston 11 by a lock nut 41.

The length of the screw rod 40 projecting from the left side of the piston 11 can be adjusted by loosening the lock nut 41, adjusting this length of projection of the screw rod 40 by turning it by means of a tool such as a screwdriver, and tightening the lock nut 41 thereby to lock the screw rod 40 in its adjusted state to the piston 11. By adjusting the projecting length of the screw rod 40 in this manner, the second-stage displacement distance of the second piston 12 can be adjusted.

Figure 4:
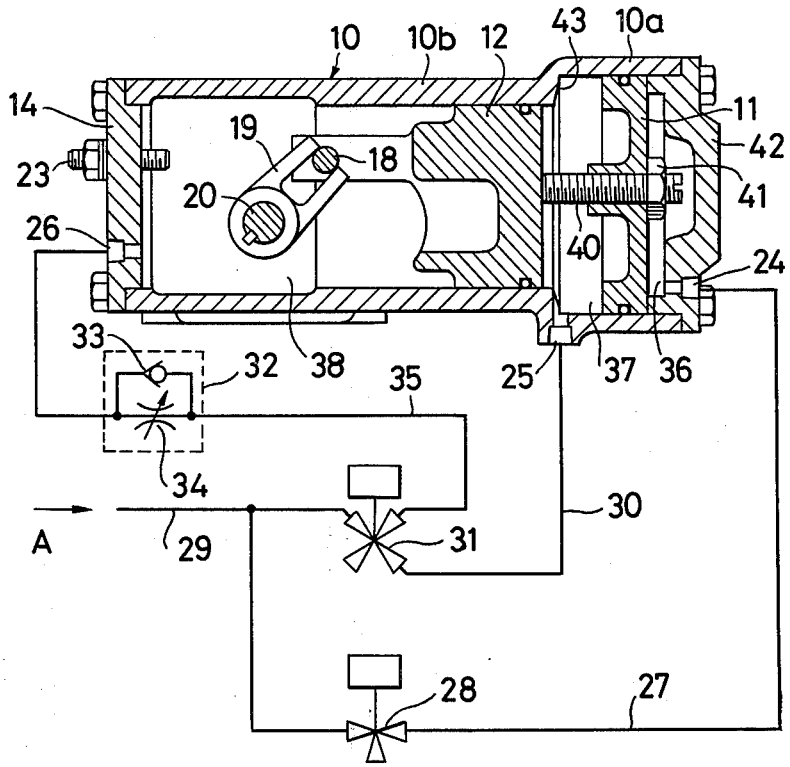
FIG. 4 is a side view, in longitudinal section, showing a second embodiment of the actuating device according to the invention.

The outer end part of the large-diameter cylinder 10*a* of the body cylinder part 10 is covered by a cylinder cover 42, which is merely required to have a shape such as to accommodate the outer end of the screw rod 40 when covering the outer end of the cylinder 10*a* since this outer end of the screw rod 40 protrudes only slightly out of the cylinder 11 toward the right as viewed in FIG. 4. Accordingly, since the screw rod 40 does not pass through the cylinder cover 42 according to this embodiment of the invention, the entire device can be made compact. The adjustment of the screw rod 40 can be carried out by removing the cover 42 from the large-diameter cylinder 10*a*.

The limiting position of the piston 11 in its leftward stroke is that position where it strikes against a shoulder or stepped part 43 provided at the boundary between the large-diameter cylinder 10*a* and the small-diameter cylinder 10*b*.

Figure 5:
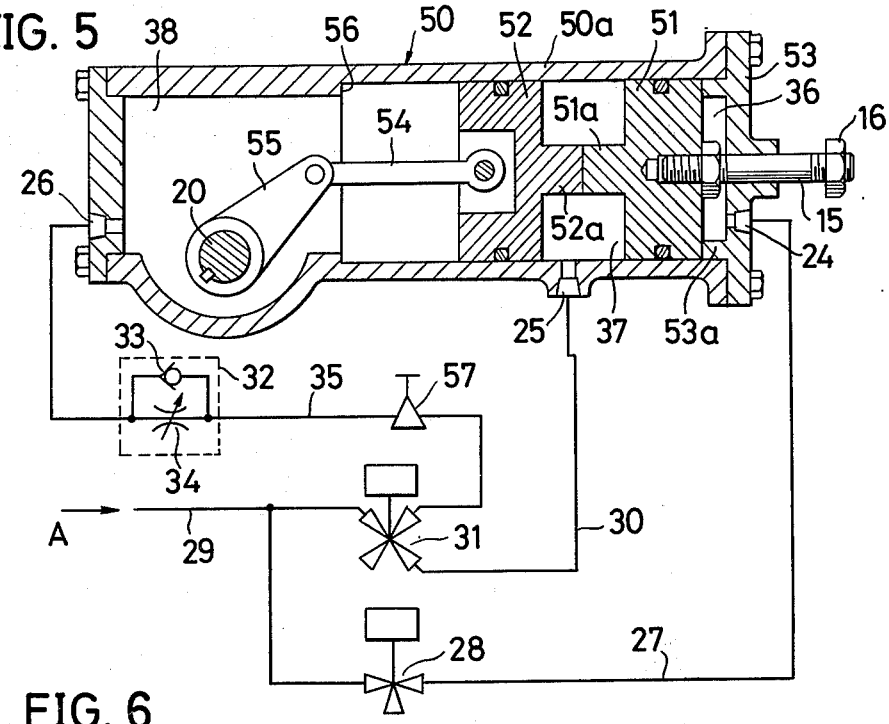
FIG. 5 is side view, in longitudinal section, showing a third embodiment of the actuating device according to the invention together with a schematic diagram of pneumatic system for supplying compressed air for operating this actuating device.

A third embodiment of the actuating device according to the invention will now be described with reference to FIG. 5, in which parts which are the same as corresponding parts in FIG. 2 are designated by like reference numerals. Detailed description of such parts will be omitted.

In this actuating device, the part 50*a* of the cylinder body 50 which has the original function of a cylinder has a constant diameter throughout its length. Within this cylinder part 50*a*, there are slidably fitted first and second pistons 51 and 52 of the same diameter. The piston 51 is nearer to the outer or right end of the cylinder part 50*a* than the piston 52. The outer end, or right end as viewed in FIG. 5, is covered by a cover 53 having a central hole through which a rod 15 is slidably passed and having an inwardly projecting annular part 53*a* for determining the limit of the rightward stroke of the piston 51. The two pistons 51 and 52 respectively have central projections 51*a* and 52*a* projecting coaxially toward each other.

The inner second piston 52 is coupled by way of a connecting rod 54 pivotally connected thereto and a crank lever 55 to the shaft 20. The leftward stroke of this piston 52 is limited by a stepped shoulder 56 provided in the inner wall surface of the cylinder body 50.

The cylinder and piston mechanism of the above described construction is connected to a pneumatic system similar to that of the preceding embodiments except for the additional provision of a pressure reducing valve 57 in the pipe line 35 between the 4-way valve 31 and the port 26.

The first and second pistons 51 and 52 accomplish the same operation as the pistons 11 and 12 of the aforedescribed first embodiment illustrated in FIGS. 1 and 2. Furthermore, the changing over valve operations of the electromagnetic valves 28 and 31 are also the same as those in the first embodiment. Accordingly, the operation of this third embodiment will be readily understandable from that of the first embodiment.

Because of the provision of the pressure reducing valve 57 as described above, the pressure of the compressed air within the chamber 38 is less than the pressure of the compressed air within the chamber 36. For this reason, although the pistons 51 and 52 are of the same diameter and have substantially equal pressure receiving areas, when compressed air is supplied through the port 24 into the chamber 36, the projecting part 51*a* of the piston 51 abuts and pushes against the projecting part 52*a* of the piston 52, whereby the piston 51 slides leftward as viewed in FIG. 5 together with the piston 52.

An advantageous feature of this embodiment of the actuating device of the invention is that, since the cylinder part 50*a* of the cylinder body 50 is entirely of constant diameter without parts of differing diameter, the fabrication of the cylinder 50 is facilitated.

Figure 6:
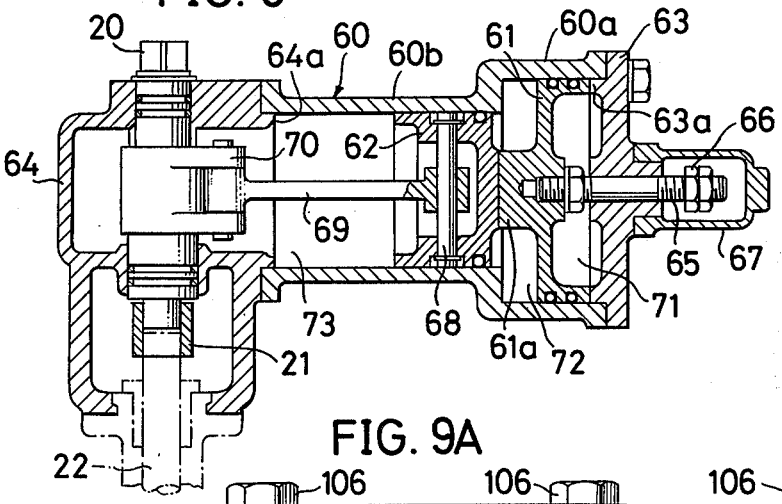
FIG. 6 is a plan view, in longitudinal section, showing a fourth embodiment of the actuating device according to the invention.
Figure 7:
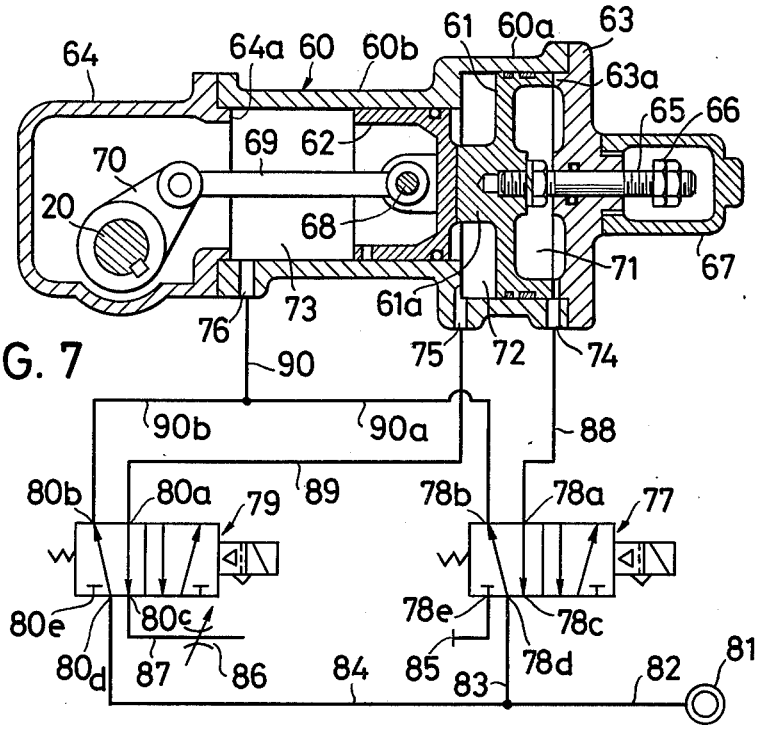
FIG. 7 is a side view, in longitudinal section, showing the device illustrated in FIG. 6 together with a schematic diagram of a pneumatic system for supplying compressed air for operating this device.

In a fourth embodiment of the actuating according to the invention as illustrated in FIGS. 6 and 7, the cylinder body 60 comprises a large-diameter cylinder part 60*a* and a small-diameter cylinder part 60*b*. These cylinder parts 60*a* and 60*b* are respectively provided with large-diameter and small-diameter pistons 61 and 62 slidably fitted therein. The outer or righthand end of the cylinder part 60*a* is covered with a cover 63 having an inwardly projecting annular part 63*a*. The cylinder part 60*b* at its end remote from the cylinder part 60*a* is covered unitarily by a hollow casing structure 64, the hollow interior of which communicates with the hollow interior of the cylinder part 60*b*.

A stop rod 65 is fixed at its inner end to the center of the large-diameter piston 61 and extends slidably through the cover 63. Stop nuts 66 are screw fastened to the outer end of the stop rod 65 outside of the cover 63. This outer end of the stop rod 65 and the stop nuts 66 are enclosed within a cap cover 67 screw fastened to the outer face of the cover 63. The leftward (as viewed in FIG. 7) stroke of the piston 61 is limited by the stop nuts 66, while the rightward stroke thereof is limited by the projecting parts 63*a* of the cover 63. Furthermore, the piston 61 is provided at its inner central part with a projection 61*a* formed integrally therewith for abutting against the piston 62.

The piston 62 is coupled to a rotating shaft 20 by way of a linkage mechanism comprising a piston pin 68, a connecting rod 69, and a crank arm 70. The shaft 20 is coupled by means of a coupling 21 to a valve shaft 22 of a valve such as a ball valve. The leftward stroke of the piston 62 is limited by a rim part 64*a* of the hollow casing structure 64.

Within the cylinder body 60, there are formed a space or chamber 71 between the cover 63 and the piston 61, a chamber 72 between the pistons 61 and 62, and a chamber 73 encompassed by the piston 62, the cylinder part 60*b*, and the hollow casing structure 64. These chambers 71, 72, and 73 are respectively provided with ports 74, 75, and 76 for introduction and discharge of compressed air as described hereinbelow.

The port 74 is connected through a pipe line 88 to a port 78*a* of an electromagnetic change-over valve 77 of spring return type. The port 75 is connected through a pipe line 89 to a port 80*a* of an electromagnetic change-over valve 79 of spring return type. Furthermore, the port 76 is connected through pipe lines 90, 90*a*, and 90*b* to a port 78*b* of the electromagnetic valve 77 and to a port 80*b* of the electromagnetic valve 79.

With the device in the state indicated in FIG. 7, a port 78*c* of the electromagnetic valve 77 is opened to the atmosphere, and a port 78*d* of the same valve is connected by way of pipe lines 83 and 82 to a compressed air source 81, a port 78*e* of the same valve being connected to a closed plug 85. Furthermore, a port 80*c* of the electromagnetic valve 79 is opened to the atmosphere by way of a pipe line 87 in which is provided a variable throttle valve 86 comprising a needle valve, while a port 80*d* of the same valve is connected by way of pipelines 84 and 82 to the compressed air source 81, another port 80*e* of the same valve being opened to the atmosphere.

The device of the above described construction according to the instant embodiment of the invention operates as follows. With the ball valve in the fully closed state, the chamber 71 is open to the atmosphere through the ports 74 and 78*c*, while the chamber 72 is open to the atmosphere through the ports 75 and 80*c*. On the other hand, the chamber 73 is being supplied with compressed air from the compressed air source 81 through the port 78*d*, pipe line 90*a*, port 80*d*, and pipe line 90*b* and further by way of the pipe line 90. Consequently, the pistons 61 and 62 are at the limiting positions of their rightward travel at which the piston 61 is abutting against and stopped by the projecting part 63*a* of the cover 63.

Then, for first-step opening of the ball valve, the electromagnetic valve 79 is held in its state as it is, and the electromagnetic valve 77 is operated to change over its port connections. As a result, the port 78*a* is connected to the port 78*d*, while the port 78*b* is connected to the port 78*e*. Compressed air is thus supplied by way of the pipe lines 82, 83, and 88 to the chamber 71, and the large-diameter piston 61 moves leftward, as it pushes the small-diameter piston 62, until it is stopped by the stop nuts 66. As a consequence, the rotating shaft 20 is turned counterclockwise to similarly turn the valve shaft 22, whereby the ball valve undergoes its first-step valve opening action.

While the port 78*b* is connected to the port 78*e*, the compressed air within the chamber 73 is not opened to the atmosphere since the outlet of the port 78*e* is closed by the plug 85, and the pistons 61 and 62 gradually move rightward as a result of a force due to the difference in their areas for receiving compressed air pressure.

Next, for causing the ball valve to undergo a second-stage valve opening action, the electromagnetic valve 79 is operated, with the electromagnetic valve 77 is held in the above described changed-over state, thereby to change over port connections. As a consequence, the port 80*a* is connected to the port 80*d*, while the port 80*b* is connected to the port 80*e*. Accordingly, compressed air is supplied through the pipe lines 82, 84, and 89 to the chamber 72, while the compressed air within the chamber 73 is discharged into the atmosphere by way of the pipe lines 90 and 90*b* and the port 80*e*. Consequently, the piston 62 is pushed rightward by the pressure of the compressed air within the chamber 72 until it strikes against and is stopped by the part 64*a* of the structure 64. Consequently, the rotating shaft 20 turns further in the counterclockwise direction, and the ball valve is caused by the resulting rotation of the valve shaft 22 to undergo its second-stage valve opening action.

Since compressed air is being supplied at this time to the chamber 71, the piston 61 remains at its most leftward position.

Then, when the ball valve is to be actuated to undergo its first-stage valve closing action, the electromagnetic valve 79 is rendered inoperative and changed over by the force of its return spring again to its original state while the electromagnetic valve 77 is held in the above described changed over state. As a consequence, the port 80*a* is connected to the port 80*c*, while the port 80*b* is connected to the port 80*d*. Then, the compressed air within the chamber 72 is discharged by way of the pipe lines 89 and 87 to the atmosphere. Since the aforementioned variable throttle valve 86 is provided in the pipe line 87, the release of the compressed air within the chamber 72 to the atmosphere is accomplished gradually. Accordingly, the piston 62 moves gradually toward the right until it strikes against and is stopped by the piston 61, which is already at the limit of its leftward stroke, and the ball valve gradually carries out its first-stage valve closing action. For this reason, water hammering in the liquid supplying pipeline accompanying the valve closing operation is positively prevented.

Then, for the second-stage valve closure (full closure) action of the ball valve, the electromagnetic valve 79 is retained in the same state as that at the time of the above described first-stage valve closure, and the electromagnetic valve 77 is rendered inoperative and changed over by spring force again to its original state. As a consequence, the port 78*a* is connected to the port 78*c*, while the port 78*b* is connected to the port 78*d*. Then, the compressed air within the chamber 71 is released to the atmosphere through the pipe line 88 and the port 78*c*. In addition, the chamber 73 is supplied with compressed air through the pipe lines 84 and 90*b* and, at the same time, with compressed air through the pipe lines 83, 90*a*. Accordingly, the piston 62, pushing the piston 61, moves unitarily therewith toward the right at a relatively high speed until the piston 61 abuts against and is stopped by the projecting part 63*a* of the end cover 63. The ball valve thus carries out its second-stage valve closing action and closes fully, whereupon the fixed quantity liquid supplying operation is completed.

Figure 8:
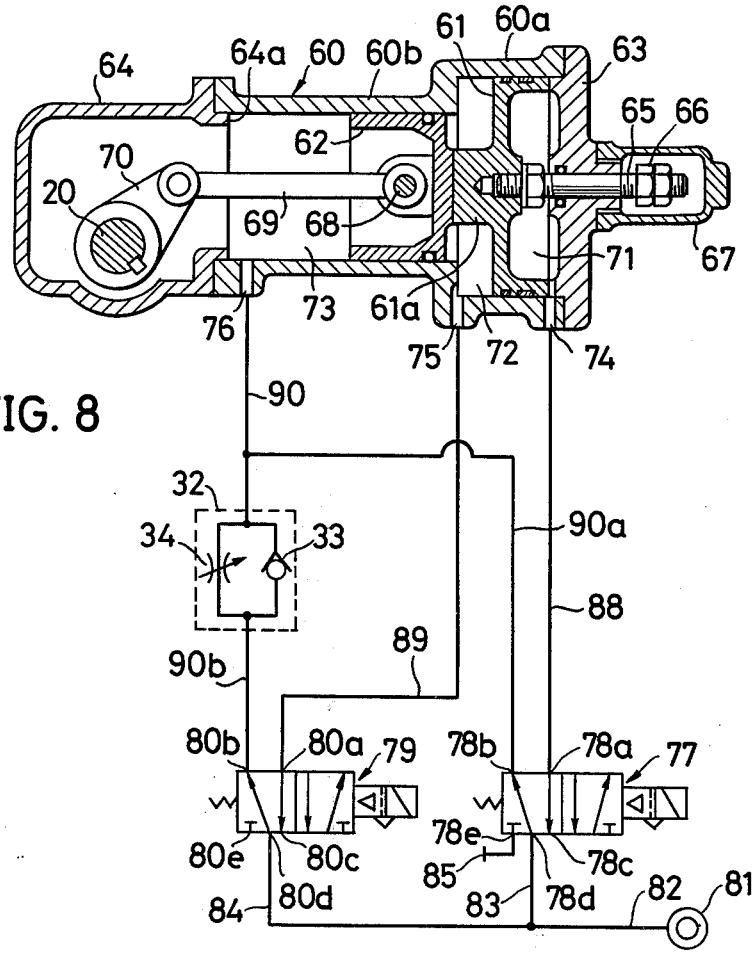
FIG. 8 is a side view, similar to FIG. 7, showing a modified embodiment of the pneumatic system of the device illustrated in FIG. 7.

A modification of a pneumatic system for supplying working compressed air of the device illustrated in FIG. 7 will now be described with reference to FIG. 8, in which parts which are the same as corresponding parts in FIG. 7 are designated by like reference numerals. Detailed description of such parts will be omitted. The points on which the pneumatic system shown in FIG. 8 differs from that shown in FIG. 7 are that the port 80*c* is directly open to the atmosphere and is not connected to a pipe line 87 having a variable throttle valve 86 and that a flowrate control device 32 comprising a check valve 33 and a variable throttle valve 34 is provided in the pipe line 90*b*.

The change over operations of the electromagnetic valves 77 and 79 accompanying the second-stage valve opening and closing actions and the attendant operations of the various parts are exactly the same as those in the preceding embodiment illustrated in FIG. 7 and will not be described again.

In the first-stage valve closing operation, the compressed air within the chamber 72 is discharged at a relatively high speed through the pipe line 89 and the port 80*c*, but the supply of compressed air to the chamber 73 is carried out gradually by way of the variable throttle valve 34 of the flowrate control device 32 provided in the pipe line 90*b*. For this reason, the first-stage valve closure is carried out in a relatively leisurely manner, similarly as in the preceding embodiment, and water hammering is thereby prevented.

Figure 9A:
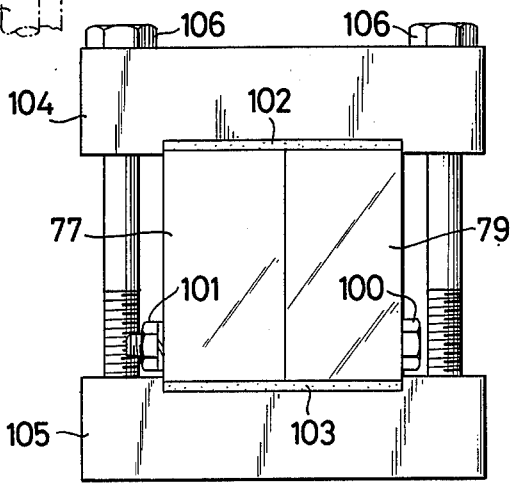
FIGS. 9A and 9B are views respectively showing embodiments of the state of mounting of electromagnetic valves used in the pneumatic system indicated in FIG. 8.
Figure 9B:
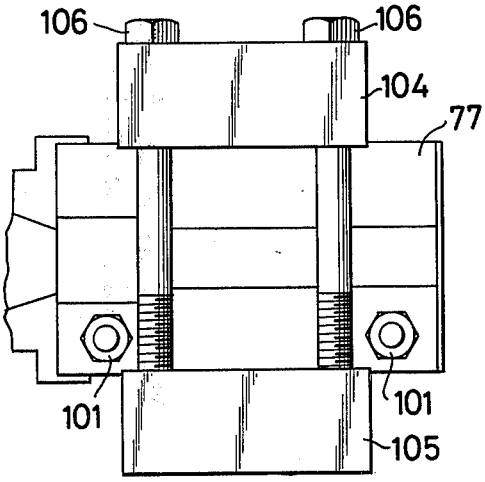

The manner in which the electromagnetic valves 77 and 79 used in the embodiment described above together with FIG. 8 are mounted will now be described with reference to FIGS. 9A and 9B.

These electromagnetic valves 77 and 79 are coupled adjacently to each other by bolts 100 and nuts 101 in a state wherein their respective ports 78*c* through 78*e* and ports 80*c* through 80*e* are facing upward. In addition, these valves 77 and 79, in the above described state, are clamped from above and below by manifolds 104 and 105 over packings 102 and 103 interposed between the manifolds and the valves and are thus fixed by bolts 106. The manifold 104 has therewithin air passageways having the functions of the pipe lines 83 and 84 and is connected to ports 78*d* and 80*d* of the valves 77 and 79. The manifold 105 has air passageways for functioning as the pipe lines 88, 90*a*, 89, and 90*b* and is connected to the ports 78*a*, 78*b*, 80*a*, and 80*b* of the electromagnetic valves 77 and 79.

By thus clamping and fixing the electromagnetic valves 77 and 79 with manifolds 104 and 105 and connecting the ports with air passageways within these manifolds, the use of air piping with copper pipes and related fittings is made unnecessary, whereby the construction is made simple and compact, and, at the same time, the possibility of air leakage developing at the piping joints is greatly reduced.

Further, this invention is not limited to these embodiments but various variations and modifications may be made without departing from the scope and spirit of the invention.

What is claimed is:

1. An actuating device comprising: a cylinder having a cylinder body of hollow cylindrical form and end parts covering two ends of the hollow interior of said cylinder body; a first and a second pistons fitted slidably within the cylinder body in spaced apart relation in the axial direction thereof, said pistons being respectively slidable separately in apart relation and unitarily in mutual contact relation in said axial direction; a first, a second and a third ports provided at the cylinder, said first port communicating a chamber defined between the first piston and the end part of the cylinder, said second port communicating a chamber defined between the first and second pistons, and said third port communicating a chamber defined between the second piston and the end part of the cylinder; stopper means for limiting the strokes in sliding motions of the first and second pistons respectively at different displacement positions; a driven structure coupled to the second piston and driven responsive to the sliding motion of the second piston; and control means for controlling the supply and discharge of a working fluid to and from the first through third ports, said control means supplying the working fluid into the first chamber whereby the first and second pistons are moved unitarily in contact relation in one axial direction from an initial position to a first stage position where the first piston is stopped by the stopper means, thereafter supplying the working fluid into the second chamber and discharging the working fluid from the third chamber whereby only the second piston is moved in one axial direction from the first stage position to a second stage position where the second piston is stopped by the stopper means, supplying the working fluid into the third chamber and discharging the working fluid from the second chamber whereby only the second piston is moved in opposite axial direction from the second stage position to the first stage position where the second piston is stopped by the first piston, and said control means thereafter supplying the working fluid into the second chamber and discharging the working fluid from the first chamber whereby the second and first pistons are moved unitarily in contact relation in opposite axial direction from the first stage position to the initial position where the first piston is stopped by the stopper means.

2. An actuating device as claimed in claim 1 in which said driven structure comprises a conversion mechanism in the third chamber for converting the sliding displacement of the second piston to rotational displacement and a rotatable shaft rotated by said conversion mechanism, said shaft extending through the cylinder body.

3. An actuating device as claimed in claim 1 wherein said control means comprises a first, a second and a third pipe lines respectively communicated to the first through third ports for supplying and discharging the working fluid, a 3-way valve for controlling the supply and discharge of the working fluid through the first pipe line, and a 4-way valve for controlling the supply and discharge of the working fluid through the second and third pipelines.

4. An actuating device as claimed in claim 1, wherein said first piston has a diameter larger than a diameter of the second piston, said cylinder body has a shape such that the parts thereof respectively accommodating said pistons have different inner diameters respectively matching said pistons at least over their respective ranges of sliding displacement, and said control means supply the working fluid to the first and third chambers when the first and second pistons are moved in one axial direction, whereby the first and second pistons are moved gradually responsive to a force due to the difference of the surfaces for receiving the pressure of the working fluid in accordance with the difference of diameters of the first and second pistons.

* * * * *